US006249927B1

(12) United States Patent
Ando

(10) Patent No.: US 6,249,927 B1
(45) Date of Patent: Jun. 26, 2001

(54) DUCT-CLEANING UNIT

(76) Inventor: Sumio Ando, 21-2, 2-chome, Izuo, Taishou-ku, Osaka (JP)

( * ) Notice: Subject to any disclaimer, the term of this patent is extended or adjusted under 35 U.S.C. 154(b) by 0 days.

(21) Appl. No.: 09/310,933

(22) Filed: May 13, 1999

(30) Foreign Application Priority Data

Dec. 22, 1998 (JP) ..... 10-363600

(51) Int. Cl.[7] ..... B08B 9/04

(52) U.S. Cl. ..... 15/104.061; 134/113; 134/166 C; 134/168 C

(58) Field of Search ..... 134/166 R, 167 R, 134/168 R, 168 C, 167 C, 169 C, 166 C, 169 R, 113; 15/3.5, 3.51, 104.061

(56) References Cited

U.S. PATENT DOCUMENTS

| | | | | |
|---|---|---|---|---|
| 1,218,005 | | 3/1917 | Schlemmer . | |
| 3,041,204 | * | 6/1962 | Green | 15/104.061 |
| 3,074,436 | * | 1/1963 | Endean | 15/104.061 |
| 3,100,534 | * | 8/1963 | Herndon, Jr. et al. | 15/104.061 |
| 3,195,548 | * | 7/1965 | Lestakis | 134/167 C |
| 3,649,983 | * | 3/1972 | Vernooy | 15/104.061 |
| 3,667,544 | | 6/1972 | Allimon . | |
| 3,731,701 | * | 5/1973 | Sugeno | 15/104.061 |
| 4,569,097 | * | 2/1986 | Echols | 15/104.061 |
| 5,127,125 | | 7/1992 | Skibowski . | |
| 5,473,787 | * | 12/1995 | Rchols | 15/104.061 |

FOREIGN PATENT DOCUMENTS

| | | | | |
|---|---|---|---|---|
| 3032532 | * | 3/1982 | (DE) | 15/104.061 |
| 22409 | * | 9/1911 | (GB) | 15/104.061 |
| 1423132 | * | 1/1976 | (GB) | 15/104.061 |
| 2-222762 | * | 9/1990 | (JP) | 134/167 C |
| 3-68483 | | 3/1991 | (JP) . | |
| 3-115089 | | 11/1991 | (JP) . | |
| 618629 | | 5/1994 | (JP) . | |
| 6-273091 | * | 9/1994 | (JP) | 15/104.061 |
| 7-88450 | | 4/1995 | (JP) . | |
| 9-133286 | | 5/1997 | (JP) . | |
| 9-197092 | | 7/1997 | (JP) . | |
| 10-141575 | | 5/1998 | (JP) . | |
| 10-174943 | | 6/1998 | (JP) . | |
| 320314 | * | 12/1971 | (SU) | 15/104.061 |
| 359070 | * | 1/1973 | (SU) | 15/104.061 |
| 597442 | * | 3/1978 | (SU) | 15/104.061 |
| 680771 | * | 3/1982 | (SU) | 15/104.061 |
| 1094631 | * | 5/1984 | (SU) | 15/104.061 |

OTHER PUBLICATIONS

European Patent Office 15/104.061, Jan. 1986.*

* cited by examiner

*Primary Examiner*—Frankie L. Stinson
(74) *Attorney, Agent, or Firm*—Browdy and Neimark

(57) ABSTRACT

An improvement of the duct-cleaning unit is disclosed for scraping the deposits from the inner surface of the flow line, which are residual in the flow lines after the completion of conveyance of any fluid material to thereby clean the flow lines as well as recover the material left in the tubing. The improvement is comprised of a pair of spherical guiding bodies coupled to lengthwise opposing ends of a connector member, one to each end, through universal joints. The spherical guiding bodies are each provided at the location near the connector with an annular pressure-carrying surface that makes fluid-tight contact at its outermost periphery with the inner surface of the tubing. The design of the present invention may make the cleaning unit smaller in size, so that the residual deposits in flow lines, in particular, at the relatively small radius bent in the flow line, may be reliably removed and pumped out the flow lines with the result of the high efficiency in cleaning process.

20 Claims, 5 Drawing Sheets

DUCT-CLEANING UNIT

BACKGROUND OF THE INVENTION

1. Field of the Invention

The present invention relates to an improvement in a cleaning unit for flow lines such as ducts, conduits or the like through which fluid foodstuffs, chemicals and the like are conveyed to the desired location, and in particular a cleaning unit to remove the deposits from the inner surface of the flow line, which are residual in the flow lines after the completion of conveyance of any fluid material.

2. Description of the Prior Art

In conveyance of slurry material such as ice cream, mayonnaise or powdery material through the flow lines, it is inevitably required to remove deposits from the inner surface of the flow line, which are residual in the flow lines after the completion of conveyance of any fluid material, thereby to keep the flow lines clean against the contamination with another fluid flow to be transported subsequently. To cope with this, cleaning tools have been well known, which are pumped through the flow line to remove or scrape the residual deposits from the inner surface of the flow line or tubing.

Disclosed in U.S. Pat. No. 3,667,544 is a prior duct-cleaner in which an elongated scraper body comprises first and second scraper members and a slender connector member operatively connected to both the scraper members and the elongated scraper body is forced to move in the tubing with making contact with the inner surface of the tubing so as to remove or scrape the deposits from the inner surface of the tubing. Another prior conduit-cleaning device is shown in U.S. Pat. No. 1,218,005 in which a length of flexible wire has around the periphery thereof a plurality of radially-extending brush units and is provided at the lengthwise opposing ends thereof with suitable guiding and propelling elements. Movement of the cleaning device in the conduit causes the brush units to scrape the residual material from the inner surface of the tubing. Any prior art is not only complicated in structure but also short of fluid-tightness or close contact at the interface between the scraper elements and the inner surface of the tubing. In particular, the severe problem has arisen such that it is very hard to remove the deposits at the relatively short radius bents with reliability and efficiency. To overcome the problems as described just above in the prior art, the present inventor developed the cleaner unit of the type disclosed in detail in Published Examined Utility Model Application in Japan No. (Hei)6-18629, in which a slender connector member integral at its lengthwise opposing ends with spherical guiding bodies is provided around the periphery thereof with doughnut-shaped annular pressure-carrying surfaces. The pressure of the material forced in the tubing may apply on any associated one of the annular pressure-carrying surfaces so as to urge the outer peripheral edge of the doughnut-shaped surface against the inner surface of the tubing thereby enhancing the fluid-tightness between the interface between the cleaning unit and the inner surface of the tubing, resulting in reliable scraping of the residual deposits in the ducts, pipes, tubing and the like. This type of the cleaning unit is used extensively for the flow lines conveying wide variations of the material.

Nevertheless, in the cleaning unit according to my prior invention as described above, the unit is entirely made of elastic material such as rubber and also the annular pressure-carrying surfaces are arranged in close relation with the slender connector member. This design requires rendering the cleaning unit greater in whole length or large-sized in order to keep the scraping edges of the unit at the attitude normal to the inner surface of the tubing at the bents in the flow lines. This makes larger the resistance exerted to the cleaning unit pumped through the flow line, especially, meandrous flow line having the successive bents, resulting in making greater the pumping pressure to propel the cleaning unit. This trend becomes a major problem in which the cleaning unit may gain high speed just after negotiating the bents so that the violent vibration may occur at every movement of the cleaning unit through the bent, resulting in causing the vibratory shock that may apply against the coupling joints and supporting sections of the flow lines whereby the tubing becomes deteriorated in mechanical strength. Moreover, the high pumping pressure may causes the disadvantageous deformation at the elastic connector member to thereby deteriorate the fluid-tightness of the cleaning unit with the inner surface of the tubing.

BRIEF SUMMARY OF THE INVENTION

The invention has for its primary object to overcome the shortcomings as described just above and more particular to provide an improvement in a duct-cleaning unit, in which a pair of guiding bodies of substantially spherical configuration is coupled to lengthwise opposing ends of a connector member, one to each end, through universal joints, the spherical guiding bodies being each provided integrally with annular pressure-carrying surface that makes fluid-tight contact with an inner surface of a tubing whereby the cleaning unit is made small in size and the residual deposits in flow lines may be reliably removed and pumped out the flow lines with the result of the high efficiency in cleaning process.

To deal with the object, the improved duct-cleaning unit of the present invention is characterized in that a pair of spherical guiding bodies are coupled for pivotal movement to lengthwise opposing joint ends of a connector member, and annular pressure-carrying surfaces are each provided around the attachment mount on any one of the guiding bodies at the location near the connector so as to make a fluid-tight contact at its outermost periphery with an inner surface of tubing.

In one aspect of the present invention the connector member is made of a material harder than that of the spherical guiding bodies and provided at its lengthwise opposing extremities with spherical joint ends that are detachably fitted for pivotal movement into complimentary recesses formed in the spherical guiding bodies. As an alternative, the spherical joint ends may be detachably supported in the complementary recesses through bearing members. The spherical guiding bodies are alternatively connected to the connector member for pivotal movement through a wire.

In another aspect of the present invention, the pressure-carrying surfaces are each formed integrally with the associated guiding body and flare radially outwardly from the attachment mount of the guiding body, thereby forming the annular doughnut-shaped recess. As an alternative, the pressure-carrying surfaces may be separately made of a material other than that of the guiding bodies and detachably fitted around the spherical guiding bodies.

In another aspect of the present invention, the annular doughnut-shaped recesses are each formed at the bottom thereof with holes for dealing with the conveyance of powdery materials. By this modified design, the pressurized fluid medium to propel the duct-cleaning unit along the tubing is permitted to partially jet out ahead through the holes to thereby blow the powdery material away from the leading spherical guiding body, resulting in keeping the leading guiding body from staining with the powdery material.

In a further another aspect of the present of a duct-cleaning unit for conveyance flow lines of any fluid material, a magnet is embedded in any one of the spherical guiding bodies for monitoring magnetically the cleaning operation the duct-cleaning unit in the flow lines.

Other objects and features of the present invention will be more apparent to those skilled in the art on consideration of the accompanying drawings and following specification wherein are disclosed several exemplary embodiments of the invention with the understanding that such variations, modifications and elimination of parts may be made therein as fall within the scope of the appended claims without departing from the spirit of the invention.

DETAILED DESCRIPTION OF THE INVENTION

Figure 1:
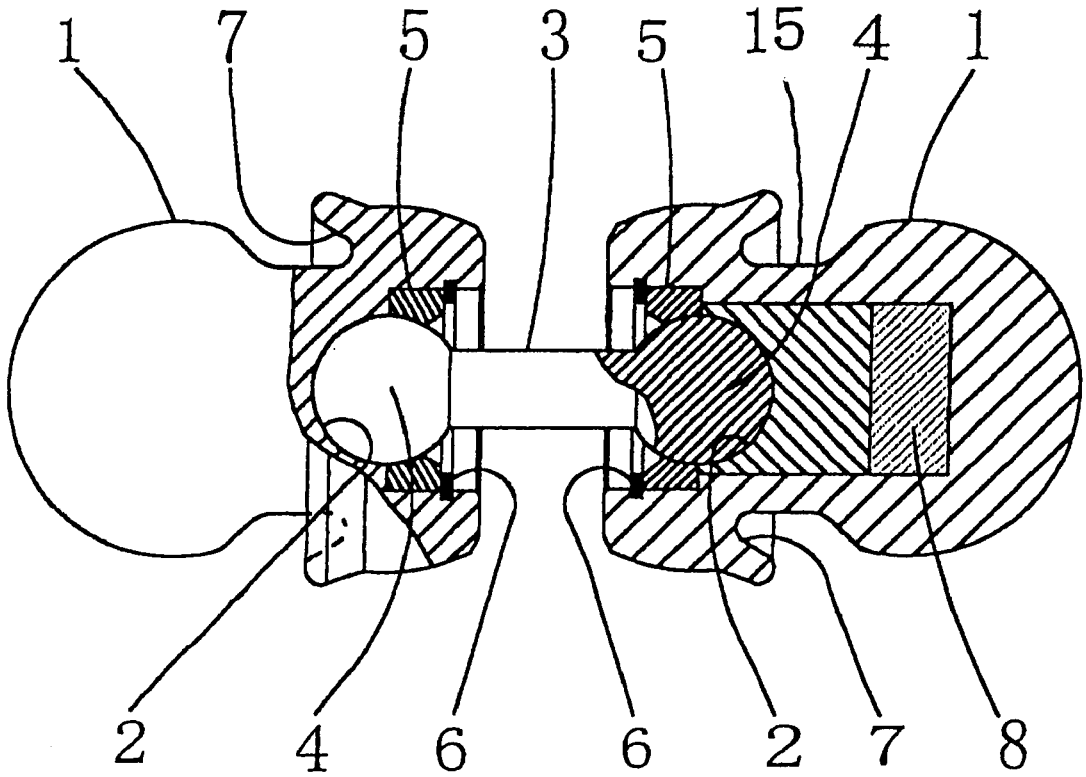
FIG. 1 is a front elevation view, partially broken away, for illustrating a first preferred embodiment of the present invention.

Referring now in detail to the drawings showing the preferred embodiments of the present invention, the first embodiment shown in FIG. 1 is the most fundamental and simple form of the present invention. This duct-cleaning unit is comprised of a pair of guiding bodies 1,1 of substantially spherical configuration each having an attachment mount 15 with a concave recess 2 at the face thereof confronting another body, a connector member 3 of dumbell-shaped type having lengthwise opposing convex ends 4,4 that are each coupled to the associated concave recess 2 in a universal joint manner and detachable manner through a spherical thrust bearing 5 and the retainer ring 6. The spherical guiding bodies 1,1 are each provided integrally with annular pressure-carrying surface 7 the outermost periphery of which may make fluid-tight contact with an inner surface of a tubing A. The pressure-carrying surfaces 7,7 are each arranged around the associated spherical guiding body 1 at the location near the connector 3 and extend radially outwardly along the spherical surface of the guiding body 1 so as to form an annular recess therebetween. Embedded in at least any one of the spherical guiding bodies 1,1 is a magnet 8 for externally monitoring the position of the cleaner unit in the conveying lines.

The spherical guiding bodies 1,1 are made of any suitable material selected in accordance with the substance conveyed along the tubing. For example, anticorrosive materials are to be employed for chemicals, whereas fluorocarbon resins are preferred for pipelines to convey foodstuffs having no fear of corrosion. Further, the connector member 3 is to be formed from any material such as stainless steel, which is less in flexibility and harder, compared with the spherical guiding bodies 1,1.

Figure 2:
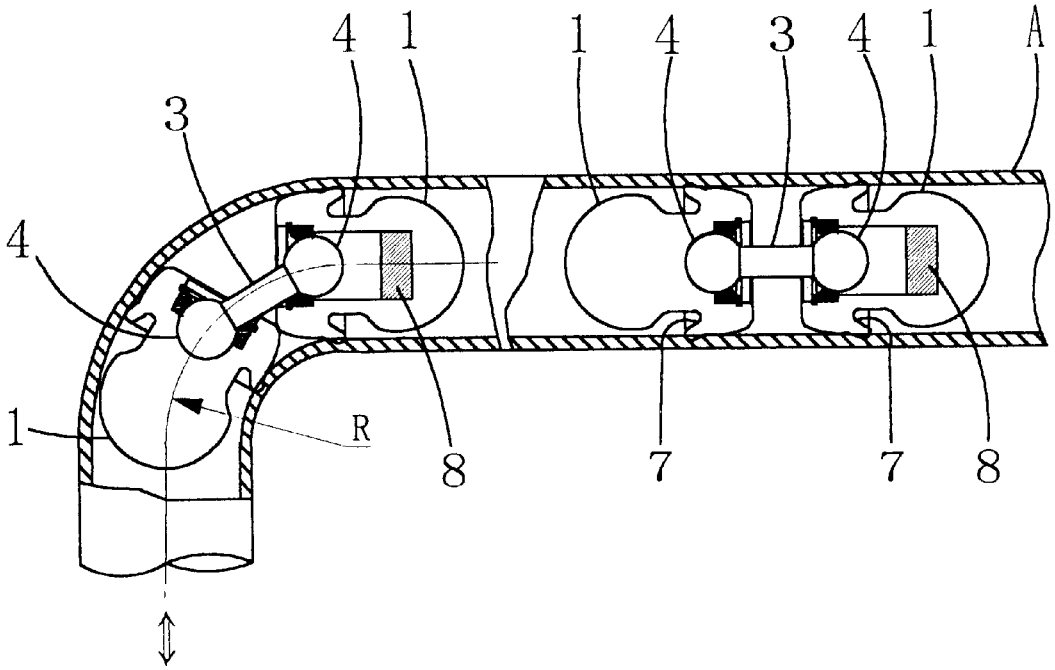
FIG. 2 is a schematic view illustrative of the operation of the duct-cleaning unit of the present Invention at a bent of the pipeline to be scraped.
Figure 3:
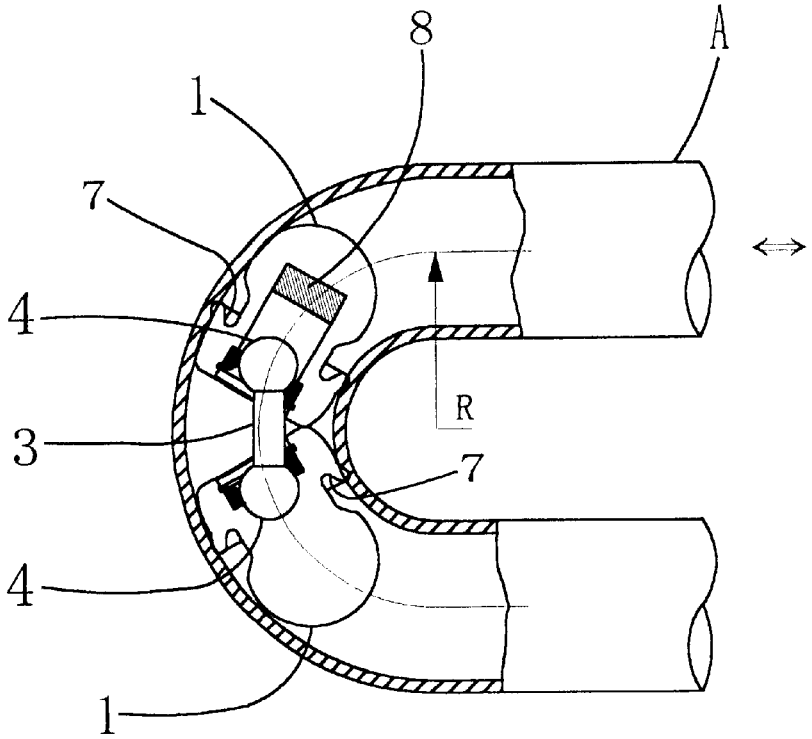
FIG. 3 is a schematic view illustrative of the operation of the duct-cleaning unit of the present invention at a relatively small radius bent of the pipeline to be scraped.

When forcibly propelling the duct-clearing unit by the action of hydraulic or pneumatic pressure towards the right in FIG. 2, the pressure-carrying surface 7 of the left or trailing spherical guiding body 1 is subjected to the propelling pressure. In contrast, with the duct-cleaning unit being thrust towards the left in FIG. 2, the pressure-carrying surface 7 of the right spherical guiding body 1 is subjected to the propelling pressure. Consequently, the dust-cleaning unit may expel the residuals of the conveyed material and also any preceding one of the pressure-carrying surfaces 7,7 may scrape efficiently the deposits on the inner surface of the flow lines, resulting in clearing the tubing A. it is to be understood that the water thrusting hydraulically the duct-clearing unit, at the same time, may wash the tubing. In particular, the pressure-carrying surfaces 7,7 are constantly kept on the fluid-tight contact with the inner surface of the tubing owing to the free articulation of the spherical guiding bodies 1,1 relatively to the connector member 3, whereby the duct-clearing unit designed according to the present invention may help ensure the reliable scraping of the deposits, even in the relatively small radius bent in the tubing A in FIG. 3.

Figure 4:
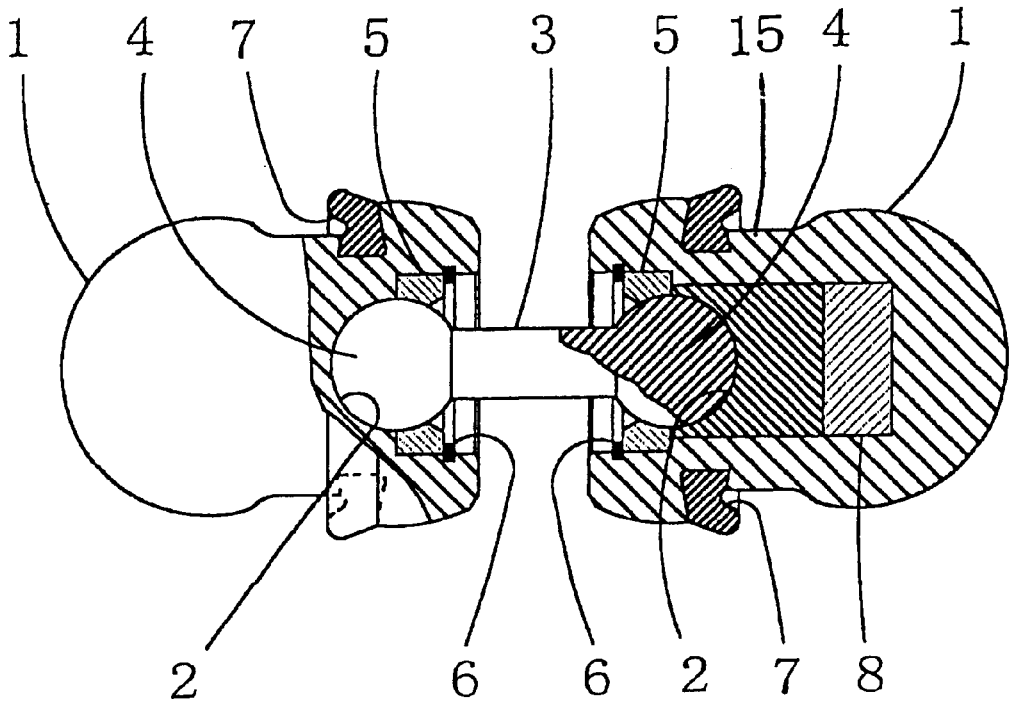
FIG. 4 is a front elevation view, partially broken away, for illustrating a second embodiment of the present invention.
Figure 5:
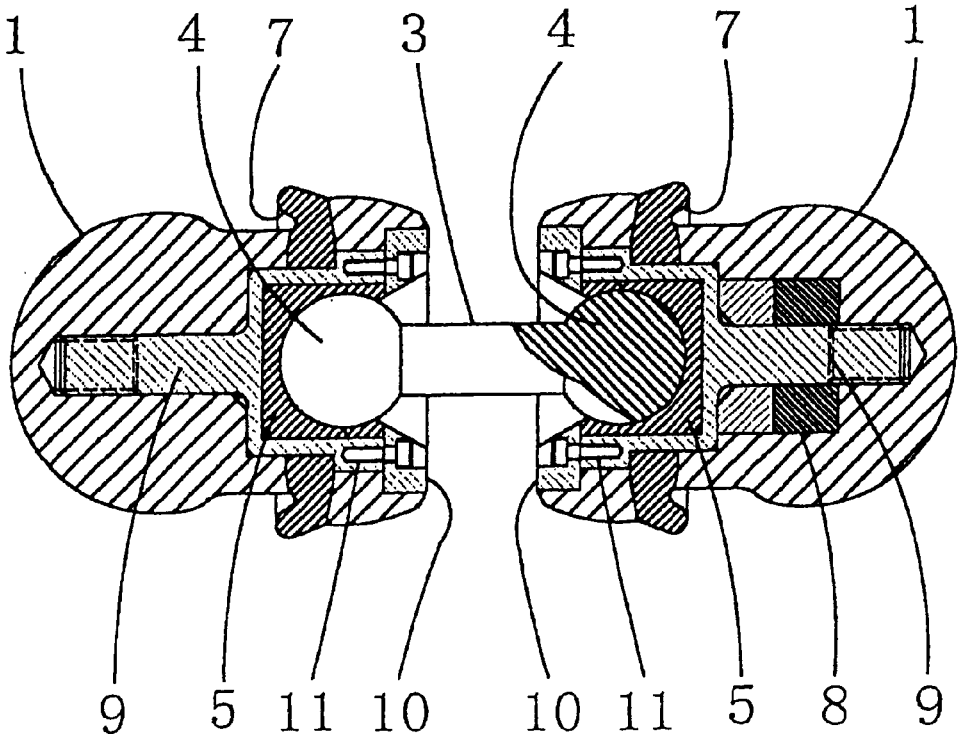
FIG. 5 is a longitudinal section, partially broken away, for illustrating a third embodiment of the present invention.

In the second embodiment shown in FIG. 4, the annular pressure-carrying surfaces 7 are made of a material other than that of the spherical guiding body 1 and fitted on the spherical guiding bodies 1. This makes it possible to prepare separately the pressure-carrying surfaces with any material such as rubber having high elasticity, which is suitable for the material to be removed. In a further another embodiment shown in FIG. 5, in addition to the pressure-carrying surfaces 7, the spherical thrust bearings 5 for supporting the associated convex ends of the connector member 3 may detachably secured the spherical guiding bodies 1 by means of fittings 9 and fixing flanges 10. This embodiment is especially adapted for the tubing large in diameter and the pressure-carrying surfaces that are selectively used, depending on the viscosity and/or kind of the material conveyed through the tubing.

Figure 6:
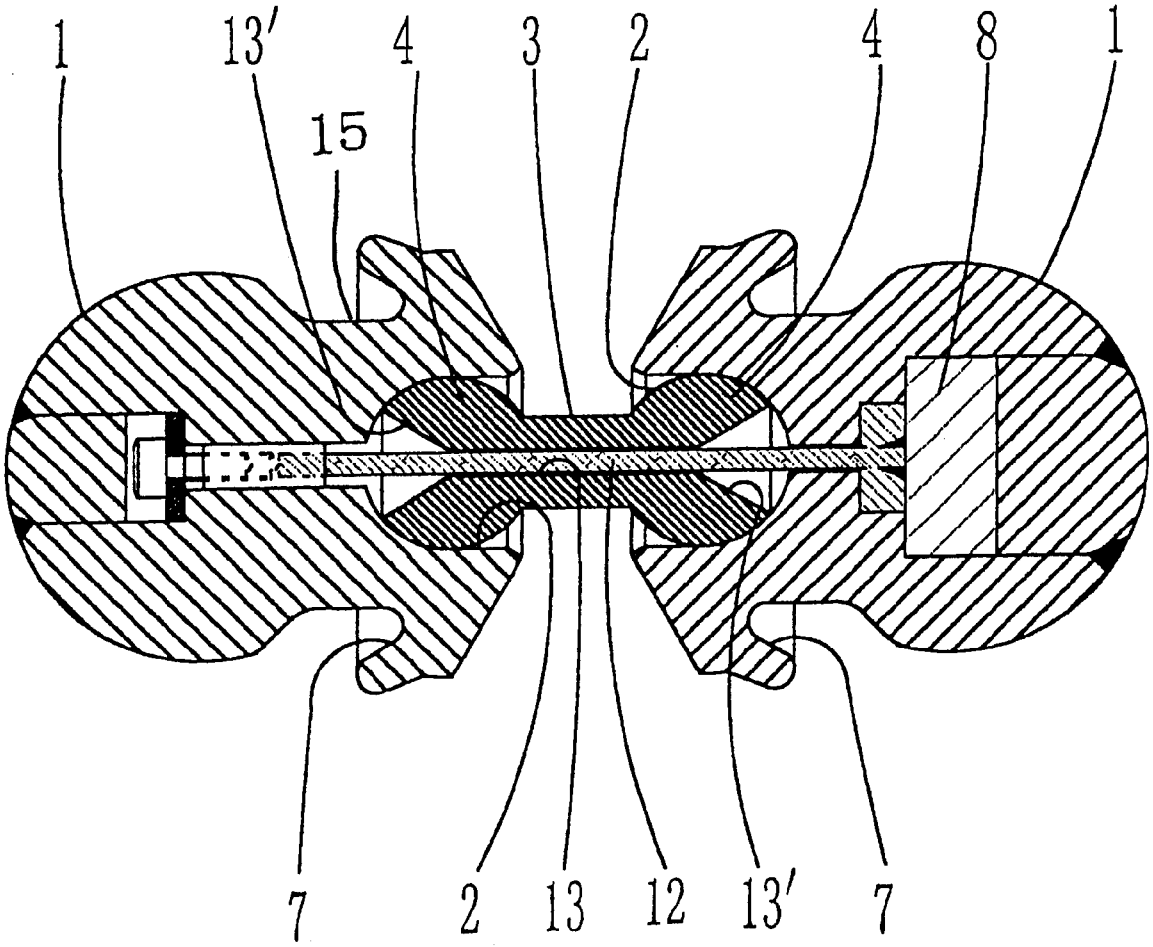
FIG. 6 is a longitudinal section view showing a fourth third embodiment of the present invention.

In the fourth embodiment shown in FIG. 6, in spite of the spherical thrust bearings 5 and retainer rings 6 described just above with reference to FIG. 1, the spherical guiding bodies 1,1 and the connector member 3 are united with each other through a wire 12 that passes axially through the guiding bodies 1,1 and connector member 3. In order to support the connector member 3 for pivotal motion, the through-hole 13 for the wire 12 in the connector member 3 is made tapered at its lengthwise opposing ends 13'.

Figure 7:
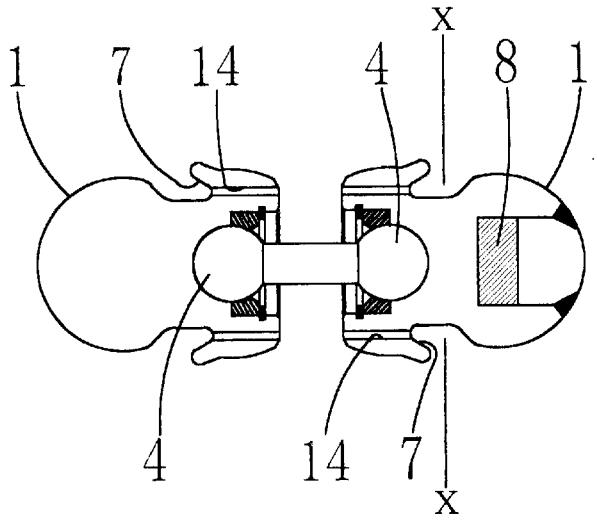
FIG. 7 is a longitudinal section view showing a fifth embodiment of the present invention.
Figure 8:
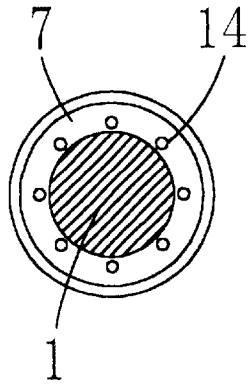
FIG. 8 is a cross-sectional view taken along the line X—X of FIG. 7.
Figure 9:
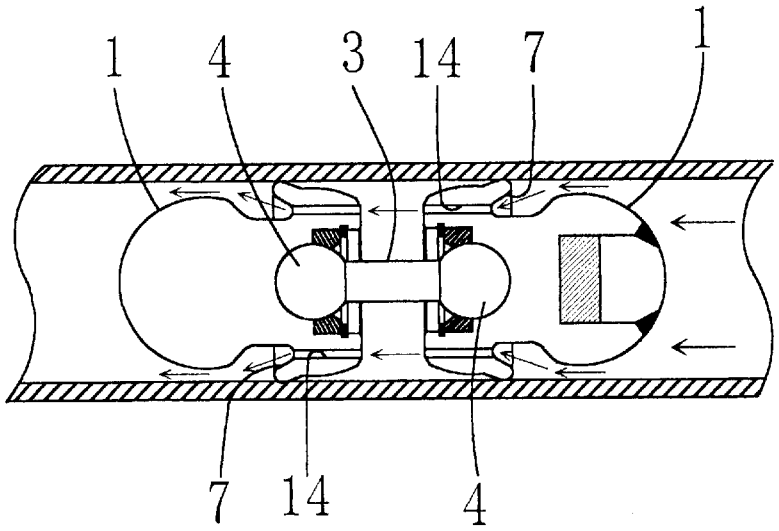
FIG. 9 is a schematic view illustrative of the cleaning operation of the fifth embodiment of the present.

The fifth embodiment shown in FIG. 7 is modified for clearing, particularly, the conveyance tubing A of powdery materials. At the bottom of each annular pressure-carrying surface 7, this modification is formed with holes 14, which are arranged spaced apart from each other around the spherical guiding body. By the modified design, the pressurized fluid medium to propel the duct-cleaning unit along the tubing A is permitted to partially jet out ahead through the holes 14 to thereby blow the powdery material away from the leading spherical guiding body 1, resulting in keeping the leading guiding body 1 from staining with the powdery material scraped from the inner surface of the tubing and thus making the cleaning operation more efficiency and easier.

In accordance with the present invention wherein a pair of the spherical guiding bodies are coupled with the connector member in a universal joint manner and the spherical guiding bodies are each provided with the annular pressure-carrying surface to scrape away the residual deposits from the inner surfaces of the tubing, the improved duct-cleaning unit is made more compact in lengthwise size while the spherical guiding bodies may snugly follow the bents of the flow lines with constantly keeping the fluid-tight contact of the pressure-carrying surfaces with the inner surface of the tubing. As the result, there is caused no loss in the pressure for propelling the cleaning unit and thus the residual deposits in flow lines may be easily reliably removed and pumped out the flow lines with the high efficiency in cleaning process, especially, at the relatively small radius bents.

In accordance with the present invention wherein the annular pressure-carrying surfaces are detachably fitted on the spherical guiding bodies, any pressure-carrying surface may be selectively available, which is most optimal for making it possible to accomplish the more reliable removal and recovery of the residual deposits, depending on the kinds, properties such as viscosity or the like, and adhesion conditions of the material to be removed.

In accordance with the present invention wherein the spherical guiding bodies are detachably coupled with the connector member in a swinging manner, the spherical guiding bodies may be easily replaced with the most suitable bodies for the material to be recovered or cleaned, for example, the corrosion resisting bodies are used for the corrosive material, or the guiding bodies are simply substituted for another bodies selected depending on the viscous resistance of the material to be scraped.

In accordance with the present invention in which the annular pressure-carrying surfaces are each formed at the bottom thereof with holes for releasing a pressurized fluid medium to propel the duct-cleaning unit along the flow lines, the leading guiding body may be kept from staining with the powdery material so that the tubing for conveying the powdery material may be reliably cleaned.

In accordance with the present invention wherein a magnet is embedded in any one of the spherical guiding bodies, the cleaning operation may be simply monitored from the outside of the tubing so that the cleaning unit may be reliably controlled through the flow lines and charged and/or discharged with respect to the tubing.

Although the invention has been described in its preferred form with a certain degree of particularity, it is understood that the present disclosure of the preferred form has been changed in details of construction and the combination and arrangement of parts may be resorted to without departing from the spirit and the scope of the invention as hereinafter claimed.

What is claimed is:

1. An improvement of a duct-cleaning unit for conveyance flow lines of any fluid material, comprising a pair of spherical guiding bodies coupled for pivotal movement to lengthwise opposing joint ends of a connector member, and annular pressure-carrying surfaces each fixed around an attachment mounting integral with any one of the guiding bodies at a location near the connector so as to make a fluid-tight contact at an outermost periphery of the pressure-carrying surfaces with an inner surface of tubing.

2. An improvement of a duct-cleaning unit for conveyance flow lines of any fluid material, constructed as defined in claim 1, wherein the annular pressure-carrying surfaces are each formed integrally around any one of the spherical guiding bodies.

3. An improvement of a duct-cleaning unit for conveyance flow lines of any fluid material, constructed as defined in claim 2, wherein a magnet is embedded in any one of the spherical guiding bodies for monitoring magnetically locations of the duct-cleaning unit in the flow lines.

4. An improvement of a duct-cleaning unit for conveyance flow lines of any fluid material, constructed as defined in claim 3, wherein the spherical guiding bodies are detachably coupled to the connector member and bearing members for the connector member.

5. An improvement of a duct-cleaning unit for conveyance flow lines of any fluid material, constructed as defined in claim 1, wherein the annular pressure-carrying surfaces are each fitted around any one of the spherical guiding bodies in a detachable manner.

6. An improvement of a duct-cleaning unit for conveyance flow lines of any fluid material, constructed as defined in claim 5, wherein a magnet is embedded in any one of the spherical guiding bodies for monitoring magnetically locations of the duct-cleaning unit in the flow lines.

7. An improvement of a duct-cleaning unit for conveyance flow lines of any fluid material, constructed as defined in claim 6, wherein the spherical guiding bodies are detachably coupled to the connector member and bearing members for the connector member.

8. An improvement of a duct-cleaning unit for conveyance flow lines of any fluid material, constructed as defined in claim 7, wherein the spherical guiding bodies are coupled with the connector member for a relatively pivotal motion through a wire.

9. An improvement of a duct-cleaning unit for conveyance flow lines of any fluid material, constructed as defined in claim 8, wherein the annular pressure-carrying surfaces are each formed at the bottom thereof with holes for releasing a pressurized fluid medium to propel the duct-cleaning unit along the flow lines.

10. An improvement of a duct-cleaning unit for conveyance flow lines of any fluid material, constructed as defined in claim 1, wherein a magnet is embedded in any one of the spherical guiding bodies for monitoring magnetically locations of the duct-cleaning unit in the flow lines.

11. An improvement of a duct-cleaning unit for conveyance flow lines of any fluid material, constructed as defined in claim 1, wherein the spherical guiding bodies are detachably coupled to the connector member and bearing members for the connector member.

12. An improvement of a duct-cleaning unit for conveyance flow lines of any fluid material, constructed as defined in claim 1, wherein the spherical guiding bodies are coupled with the connector member for a relatively pivotal motion through a wire.

13. An improvement of a duct-cleaning unit for conveyance flow lines of any fluid material, constructed as defined in claim 1, wherein the annular pressure-carrying surfaces are each formed at the bottom thereof with holes for releasing a pressurized fluid medium to propel the duct-cleaning unit along the flow lines.

14. A duct-cleaning unit for cleaning conveyance flow tubing for carrying fluid materials, said unit comprising:

a pair of spherical guiding bodies each having an outer diameter less than an inner diameter of the tubing, an attachment mount projecting from a side of each of the spherical guiding bodies, each of opposite ends of a connector member being pivotally engaged within said attachment mount to couple the spherical guiding bodies together, and annular pressure-carrying surfaces respectively fixed to and around each attachment mount, wherein each of the pressure-carrying surfaces makes a fluid-tight contact at an outermost periphery thereof with an inner surface of the tubing.

15. The duct-cleaning unit as defined in claim 1, wherein the annular pressure-carrying surfaces are each respectively formed integrally with the attachment mount.

16. The duct-cleaning unit as defined in claim 1, wherein the annular pressure-carrying surfaces are each respectively fitted to the attachment mount in a detachable manner.

17. The duct-cleaning unit as defined in claim 16, wherein a magnet is embedded in any one of the spherical guiding bodies for monitoring magnetically locations of the duct-cleaning unit in the flow tubing.

18. The duct-cleaning unit as defined in claim 17, wherein the spherical guiding bodies are detachably coupled to the connector member and bearing members for the connector member.

19. The duct-cleaning unit as defined in claim 1, wherein holes for releasing a pressurized fluid medium to propel the duct-cleaning unit along the flow tubing are formed between the outermost periphery of the pressure-carrying surfaces and the attachment mount.

20. The duct-cleaning unit defined in claim 1 wherein said annular pressure-carrying surfaces respectively flare radially outwardly toward a corresponding guiding body to form an annular doughnut-shape recess.

* * * * *